United States Patent [19]

Abramson

[11] Patent Number: 4,749,843

[45] Date of Patent: Jun. 7, 1988

[54] ENVELOPING RADIANT HEATER

[75] Inventor: Andrew E. Abramson, Excelsior, Minn.

[73] Assignee: Research, Inc., Eden Prairie, Minn.

[21] Appl. No.: 918,482

[22] Filed: Oct. 14, 1986

[51] Int. Cl.[4] ..... H05B 3/06; F26B 13/10

[52] U.S. Cl. ..... 219/411; 219/521; 432/224; 432/225; 34/41; 34/148; 34/107

[58] Field of Search ..... 432/8, 224, 225; 34/4, 34/41, 105, 107, 148; 219/411, 405, 524, 521, 390, 400, 343, 388, 388 S

[56] References Cited

U.S. PATENT DOCUMENTS 2,654,587 10/1953 Skivesen ..... 432/8

4,558,203 12/1985 Bauridl ..... 219/214

*Primary Examiner*—A. D. Pellinen

*Assistant Examiner*—H. L. Williams

*Attorney, Agent, or Firm*—Kinney & Lange

[57] ABSTRACT

A heater for presenting an object to be heated on a carrier to a pair of heating structures which open from an initially closed position to receive same. The initial position of the carrier results in the heating structures being together initially and its motion then results in opening them to receive the object depending on the position reached by the carrier. The closing of the heating structures, due to further motion of the carrier, about the object to thereby envelop it reduces heating losses during the heating of the object.

69 Claims, 8 Drawing Sheets

ENVELOPING RADIANT HEATER

BACKGROUND OF THE INVENTION

1. Field of the Invention.

The present invention relates to radiant heaters which envelop portions of the object to be heated and, more particularly, to such heaters where the object to be heated is presented to the heater by a carrier causing the heater to open to receive the object when the carrier reaches a proper position with respect thereto.

Radiant heaters have been used for industrial purposes for a long time. They have a wide range of uses, everything from paint drying to shrinking heat-shrinkable tubes over wiring bundles or the like. In this latter use, shrinking heat-shrinkable tubing, many other methods have also been used. These include using a resistance heating clamp which can be placed around both an elongated object, such as a bundle of wires, and a heat-shrinkable tube portion positioned thereover. Another method is based on using a hot air blower which has a stream of hot air therefrom directed by the operator over surfaces of the heat-shrinkable tube portion previously placed around such a bundle of wires. A common radiant heating method is to use a radiant heater with a reflector behind the radiation source to direct the radiant energy onto heat-shrinkable tube portions placed around the elongated object with again the concentrated heat directed over the heat-shrinkable tubing.

These methods have a number of shortcomings as a means of shrinking heat-shrinkable tubing over elongated objects such as bundles of wires or optical fibers, piping, or other objects. A great deal of energy is dissipated in these foregoing methods without obtaining any value therefrom because of the repeated missing of the heat-shrinkable tubing by the radiant energy, or alternatively by the heated air stream, as the operator overshoots the edge of the heat-shrinkable tubing time after time in directing energy over the surface of that tubing.

Similarly, a clamp arrangement that must be constantly opened by an operator, and who will often leave it open, is an arrangement which leads to substantial energy losses.

An even more significant problem is the variability, sometimes leading to unreliability, in the quality of the product obtained. Thus, unsatisfactory shrinking of heat shrinkable material can occur because of a lack of operator skill or momentary inattention by the operator. This leads to the need for additional training of operators, and to additional inspection of the work product of such operators.

This need for operator skill, and constant operator concentration on the work being done, is being increased by virtue of new applications for heat shrink tubing technology. Among these is the use of a section of heat-shrinkable tubing with a solder preform provided therein. This is used, for instance, where an additional wire is to be added as a branch to the center of another main wire. By placing a heat-shrinkable tube section with the solder preform in it over the end of the branching wire and over the main wire at a location where the insulation therearound has been removed, the application of heat will cause the heat-shrink tubing to close its ends and the solder to melt. The melted solder runs to join the two wires together with the solder being prevented from flowing away from the connection region by the heat-shrinkable tubing section being shrunk.

Another growing application which requires skill and care is the providing of shrinkable tubing around fiber optic bundles. These hair-thin fibers must be handled very carefully because of their fragility. The heat-shrink tubing is also often shrunken over a splice of two ends of such a fiber and must be done in such a way that no air entrapment occurs which would reduce the support provided to the splice by the shrunken heat-shrinkable tubing.

Thus, there is a desire for a heater which can provide uniform and reliable heating of elongated objects, and particularly those having heat-shrinkable tubing thereover which is to be shrunken by heat. A heater arrangement which could be scaled up in size or down in size to handle heating a variety of objects in various settings would also be quite desirable, as would be one which could be controlled at a distance to permit use in an automated production system. Such production systems could be either batch systems or, more desirably in many situations, continuous systems. An arrangement which could be adapted for use in other kinds of elongated object heating applications would also be very useful, applications such as joining of pipe sections, heating elongated test specimens or the like.

SUMMARY OF THE INVENTION

The present invention provides a heater for presenting an object to be heated on a carrier to a pair of heating structures which, though initially closed against one another, open to receive at least a portion of the object when the carrier is in the proper position to insert that portion. This is accomplished by a slide carrier being connected to a pair of heating structures such that motion of the carrier causes the heating structures to be brought together or to be spread apart, depending on the position of the carrier.

The placing of the object to be heated on the carrier, and then moving the carrier to cause the heating structures to first open and then close, permits the heated portion of the object to be enveloped by the heater with the heat applied in an enclosed setting to minimize energy loss. Further, the heat can be provided between the heating structures in a uniform manner both as to temperature and time. Further, blowing of an air stream between the heater structures can cool certain portions of the object with respect to others to delay heating or delay the extent of heating at those cooled portions from that which it would otherwise be.

DETAILED DESCRIPTION OF THE PREFERRED EMBODIMENTS

Figure 1:
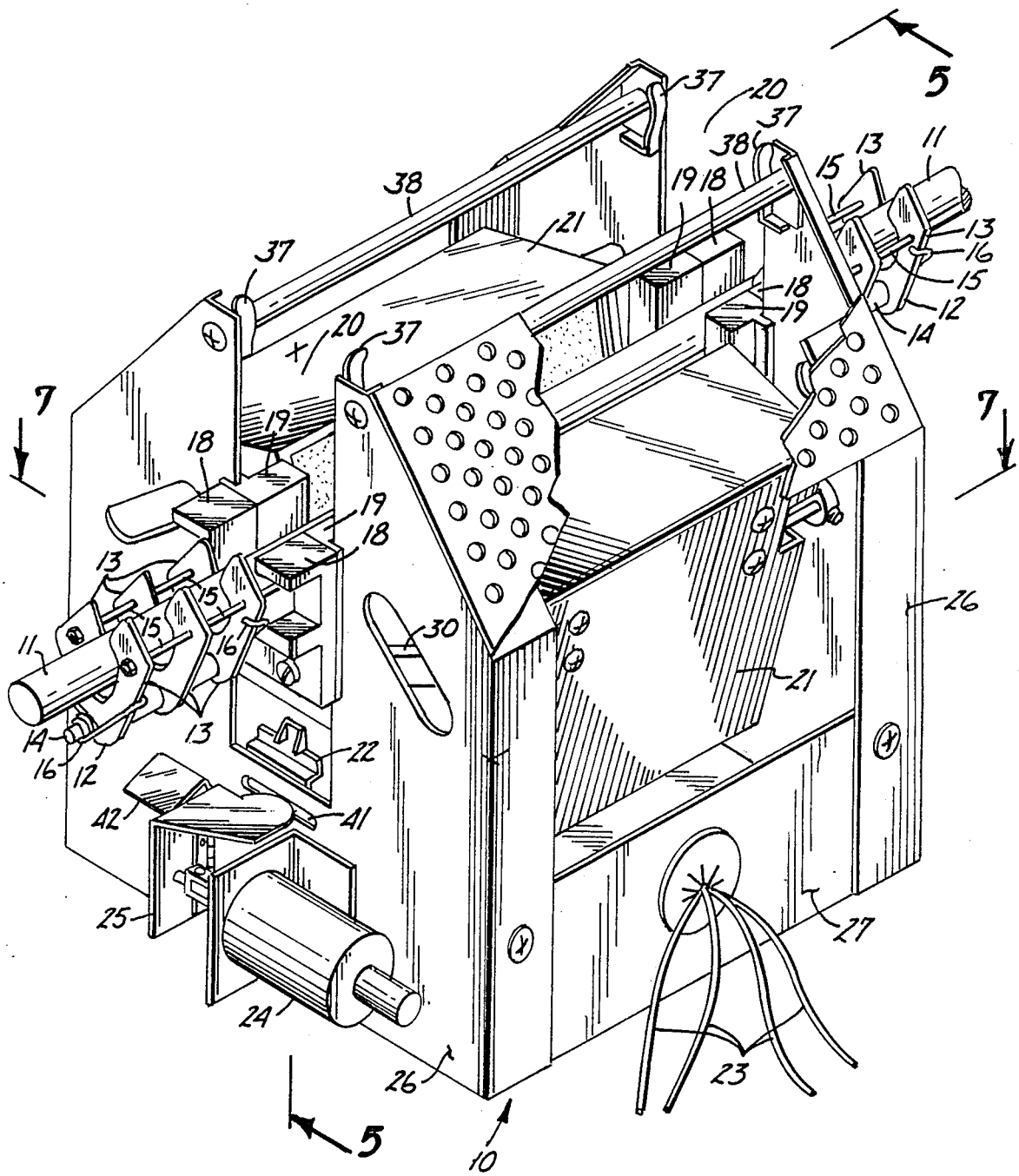
FIG. 1 shows an overview of the heating system of the present invention.

FIG. 1 shows a heating system, 10, for providing heat to an elongated object, 11, here shown as featureless merely as an example. Object 11 could be a bundle of wires or a bundle of optical fibers around which shrinkable tubing is to be formed, or it could be pipes being joined by a bondable material at a joint, or the like, as indicated above.

Object 11 is shown being held by two grippers, 12. Grippers 12 are each formed of three pairs of opposing gripping arms, 13, each of which can rotate about a pivot shaft, 14. Each gripping arm 13 on the same side of the three pairs of gripping arms is joined by a support rod, 15. Each side of the three opposing pairs of gripping arms 13 so joined by a rod 15 are urged toward the other side by torsion springs, 16, so that gripping arms 13 hold object 11 between central openings formed by each pair of opposing arms.

However, object 11, in being placed in grippers 12, that is, placed in such central openings between opposing pairs of gripping arms 13, is pushed down from above against inclined surfaces, 17, of gripping arms 13. This downward push on object 11 forces apart the opposing sides of each pair of arms 13, each side being jacked by rod 15, against the opposing force of tension springs 16. As the force of springs 16 is overcome, object 11 reaches the central openings in arms 13 so that each can close over object 11. The travel inward at the urging of springs 16 of each side of the opposing pairs joined by rod 15 is limited by an extension of rod 15 encountering a push extension, 18, affixed to a slide carrier, 19.

Grippers 12 provide a convenient means of pushing elongated object 11 into place over slide carriers 19 for presentation to the rest of heating system 10, and to hold object 11 in that place with respect to carriers 19. After heating and any other process steps are completed in the remaining portions of system 10, object 11 can be released from grippers 12 conveniently by pulling it upward.

Another push downward on the upper surface of push extensions 18 forces each extension 18, and each slide carrier 19 to which it is affixed, downward in elongated guide openings, 20. This causes the central portion of object 11, the portion between those parts thereof in grippers 12, to be inserted between a pair of heating structures, 21, containing radiant heaters for heating that central portion of object 11. Heating structures 21, which have their inner faces across from one another, which are the places at which heat is primarily provided, are together against one another if slide carriers 19 are in the uppermost extreme of the ranges of travel of each in openings 20. The pushing force on extension 18, and so on slide carriers 19, causes heating structure 21 to spread apart to permit the insertion of the central portion of object 11 therebetween as slide carriers 19 reach intermediate positions in the ranges of travel thereof. This occurs because of mechanical connections between carriers 19 and heating structures 21 to be described below.

The completion of the pushing of slide carriers 19 to the opposite extremes of the range of travel permitted each, so that carriers 19 are in the lowest portion of elongated openings 20 as can be permitted, causes heating structures 21 to close against one another and to surround the central portion of object 11 for heating that portion. Slide carriers 19 are held at the lowermost ends in the ranges of motion permitted them through the engagement thereof by spring restraints, 22.

Controllers, not shown, provide signals through interconnection wires, 23, which both set the temperature in the interior between heating structures 21, and provide timing signals to control the duration of time in which the interior portion of object 11 is kept between heating structures 21. Upon the elapse of a sufficient amount of time, signals along wires 23 cause an electrical solenoid, 24, to retract the solenoid plunger pulling along a restraint release actuator, 25. Actuator 25 then pushes spring restraints 22 out of engagement with slide carriers 19.

Springs not seen in FIG. 1 act on the mechanical connections between carriers 19 and heating structures 21 to force slide carriers 19 upward back to the uppermost extreme of their permitted ranges of motion. Again, heating structures 21 are spread apart along this range of motion to permit extracting object 11 from therebetween and bring it along with carriers 19 back to its original position.

Slide carriers 19, in moving up and down in guide openings 20, have slots in the sides thereof which engage heating system frame sides bounding openings 20. These sides bounding guide slots 20 are formed by portions of end members, 26, of the frame of heater system 10. End members 26 are joined by a central frame member, 27, which holds end members 26 in a fixed orientation with respect to one another.

Figure 2C:
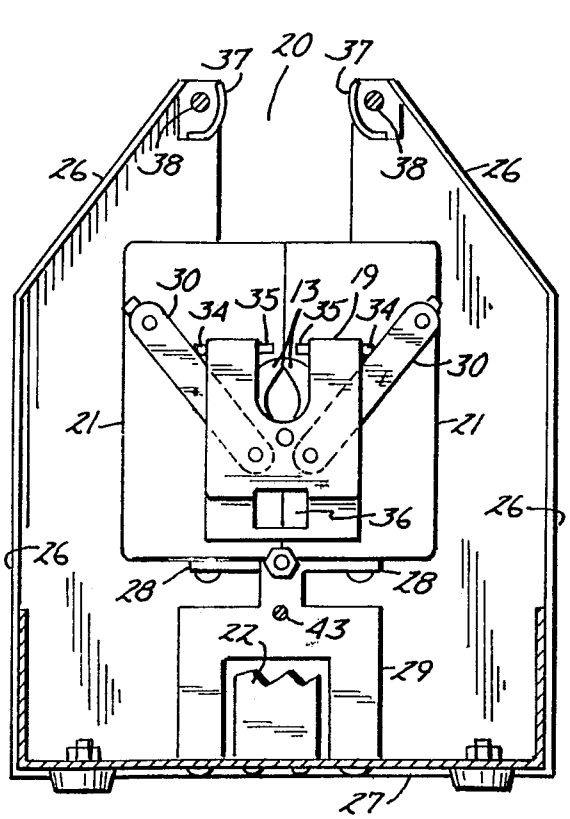
FIGS. 2A, 2B, 2C, 3A, 3B and 3C show several positions of components moving in operation of the present invention.
Figure 2B:
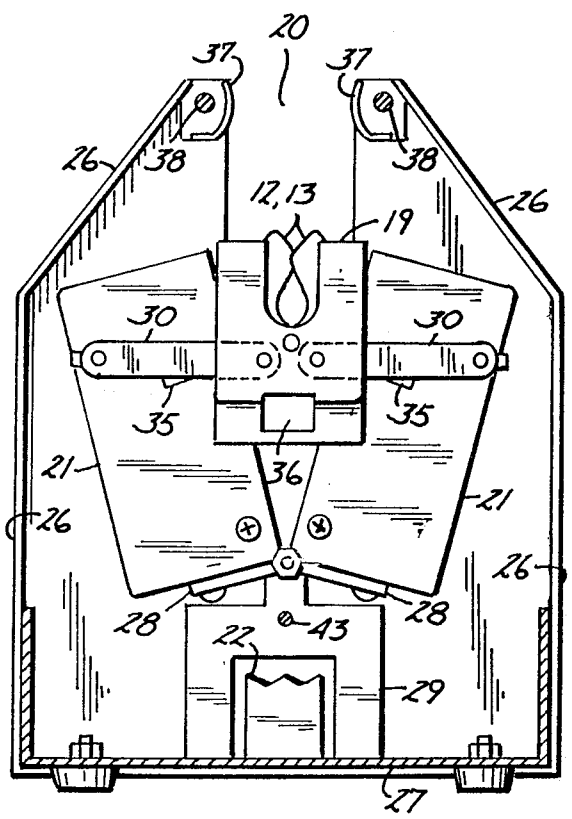
Figure 2A:
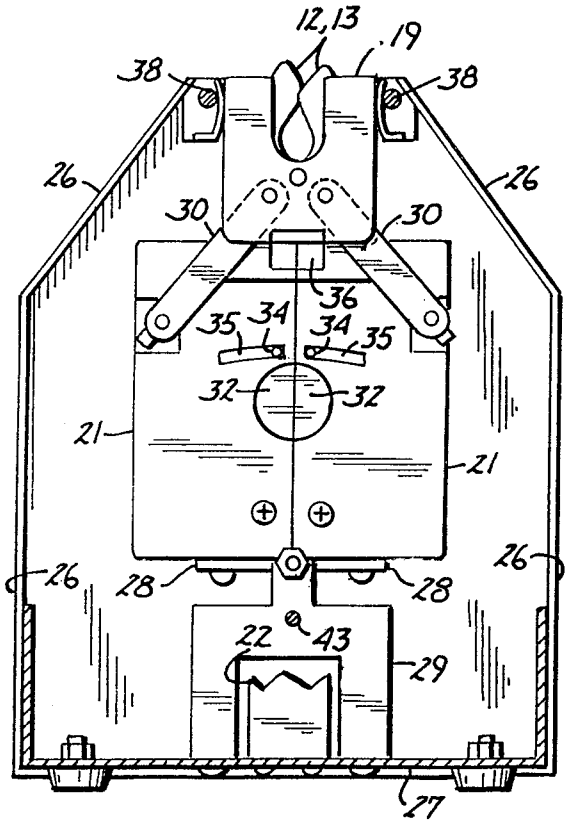

The ranges of motion permitted slide carriers 19 and the corresponding ranges of motion of heating structures 21 can best be seen in FIGS. 2A, 2B and 2C. These figures represent looking into an end of heating system 10 of FIG. 1 with end member 26 on that end removed along with everything outside of that end member 26. In addition, elongated object 11 is also not shown in these figures and neither are any electrical interconnections.

In FIG. 2A, heating structures 21 are shown joined together by a hinge, 28, having two hinge plates joined by a pivot pin which also goes through a portion of a support standard, 29. Heating structures 21 are free to pivot about the pivot pin in hinge 28. Standard 29 is in turn mounted to central frame member 27.

There are two mechanical connections between slide carrier 19 and heating structures 21. These mechanical connections are made by connecting arms, 30, with each of these arms connected to slide carrier 19 and each connected to an alternative one of heating structures 21. The connection of an arm 30 to slide carrier 19 is made by a pivot pin allowing each of arms 30 to rotate with respect to slide carrier 19.

The opposite end of each connecting arm 30 is connected to a corresponding one of heating structures 21 with another pivot arrangement. Here, however, a rod through connector 30 is held fixed in place with respect to connecting arm 30, for instance, by a set screw. This rod goes all the way through the heating structure 21 to the opposite connecting arm on the other side of that heating structure. This opposite arm is also held fixed with respect to this rod, but the rod itself can pivot within pivot supports affixed to the back plate of heating structure 21.

In FIG. 2A, slide carrier 19 is shown at the uppermost extreme of its permitted range of motion. A gripper 12, affixed to the opposite slide carrier, can be seen in this figure. Connecting arms 30, and so slide carrier 19, are urged upward toward this extreme by torsion springs, 31, placed about the pivot rod through corresponding heating structure 21 and acting on the connecting arms on either side thereof (See FIG. 4). However, since slide carrier 19 holds arms 30 at a fixed distance with respect to its vertical center line by the connection of arms 30 thereto, springs 31 act to not only keep slide carrier 19 up but to force each heating structure 21 against the other with the inner face of each in contact with one another. Thus, the pair of heating structures 21 are positioned to close off the inner face of each from the exterior to thereby reduce loss of the heat being provided primarily at such inner faces.

Further shown in FIG. 2A are a pair of doors, 32, which occur on either end of heating structures 21 to close off, in this position of slide carrier 19, a chamber, 33, (see FIG. 5) in which the central portion of object 11 is heated when inserted between heating structures 21. Doors 32 thus represent a further measure to reduce loss of the heat being provided at the inner face of each of heating structures 21 (see FIG. 6).

Figure 3C:
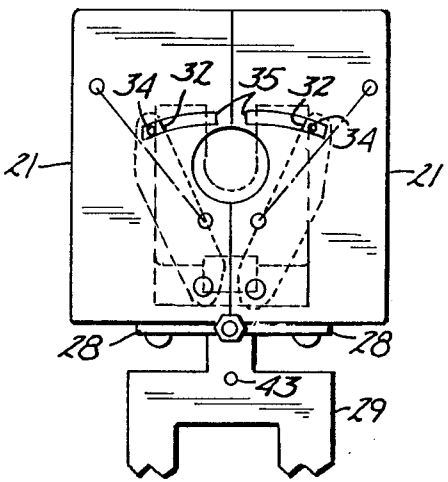
Figure 3B:
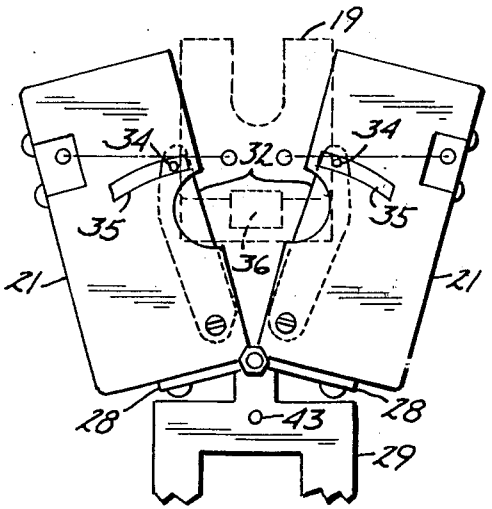
Figure 3A:
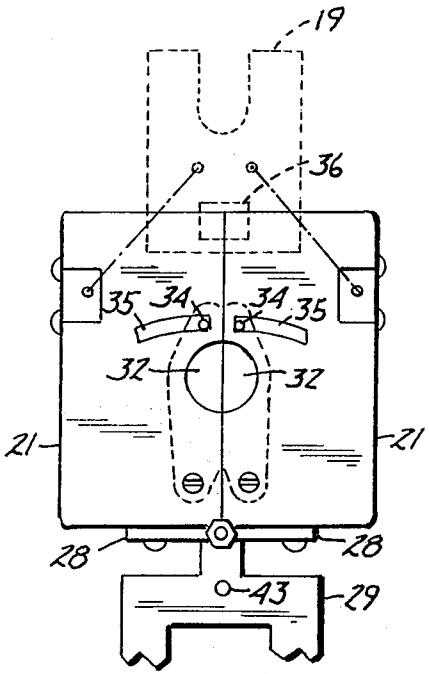

The operation of these doors is shown in FIGS. 3A, 3B and 3C which correspond with FIGS. 2A, 2B and 2C, respectively. That is, FIG. 3A is a reduced version of FIG. 2A in which frame members 26 and 27 are eliminated as are the details of arms 30 and slide carrier 19. However, dashed line representations are provided for slide carrier 19 and arms 30 to show their relative positions without blocking the view of the doors 32, the hidden portions of which are shown by dashed lines in FIG. 2A. In other respects, FIG. 3A corresponds to FIG. 2A.

As can be seen in FIG. 3A, there are pins, 34, extending through and beyond both sides of doors 32, pins 34 on one side of doors 32 extending into slots, 35, in heating structures 21, there being a pin 34 through each door 32 into each slot 35 in each end plate of each heating structure 21. Slide carrier 19, in the uppermost extreme in its range of motion in guide slot 20, does not interact with doors 32 or pins 34 at that end of its range of motion.

In FIG. 2B, a downward push on the upper surface of extension 18 of FIG. 1 has caused slide carrier 19 to begin moving downward in its range of motion in guide slot 20 reaching a midway point in that figure. Arms 30 connected to slide carrier 19 are moved to a horizontal position and force heating structures 21 apart from one another, thereby providing a substantial space therebetween. Any elongated object within the central openings of the gripping arms 13 of gripper 12, openings which can be seen in FIG. 2A to be aligned with a location above the bottom of the vertical opening in slide carrier 19, is permitted to be carried by slide carrier 19 and gripper 12 and presented into the space between heating structures 21. In this manner, the heating space in chamber 33 behind doors 32 is opened to accept elongated object 11 (not shown in FIG. 2A) for heating, an object which is carried into that position by slide carrier 19.

In corresponding FIG. 3B, slide carrier 19, in its downward motion due to a downward push on extension 18, engages pins 34 separating them slightly further than they were by the spreading of heating structures 21. Thereafter, slide carrier 19 passes between these pins. The additional separation of pins 34 by slide carrier 19 at this point of its downward travel leads to doors 32 being carried back somewhat from their initial position of one being more or less flush at each inner face of each heating structure 21.

Note that the separation of heating structures 21, forced by the action of slide carrier 19 on arms 30 in its downward travel, occurs by rotation about the pivot pin in hinge 28. In practice, there are two pivots about which heating strctures 21 rotate because there is a second hinge 28. That is, there are two hinges; one each toward the opposite ends of the lower plate forming the underside of heating structures 21. The pivot pins of each of hinges 28 lie approximately along the same axis. As a result, the direction of motion in the range of motion of slide carriers 19 is perpendicular, or othogonal, to the motion of heating structures 21 just as they come together or just as they separate, in directions perpendicular or orthogonal to the directions of motion of heating structures 21 over their permitted ranges of motion.

However, this is not the only arrangement in which the action of a slide carrier on mechanical connecting arms, acting in turn on heating structures, could provide the results already indicated. That is, other similar arrangements could have the effect of closure of heating structures 21 at their inner faces for slide carriers 19 being at each extreme in the ranges of motion thereof, but having structures 21 separated at intermediate locations in the ranges of motion of carriers 19. For instance, each heating structure could be arranged on separate pivots not necessarily aligned with one another. They could be arranged to avoid a substantial amount of rotation by having a relatively linear reciprocal motion by placing them in tracks which would accommodate such motion. In these sorts of situations, the directions of motion of the heating structures in their range of motion, and the direction of motion of the slide carriers in their ranges of motion need not always be completely perpendicular or orthogonal to one another, but will be to a substantial degree to permit the slide carriers to present an object between the heating structures 21 for heating.

A further possibility would be to have just one of heating structures 21 movable, and have it brought together against a further stationary heating structure, and later separated therefrom, by the substantially perpendicular orthogonal motion of a slide carrier. In this circumstance, for instance, the slide carrier may have a mechanical connection such as by an arm to only one of the heating structures with the other being stationary. Further, in such an arrangement it may be convenient to have the inner faces between the heating structures 21 not formed in flat planes, for instance, but in curved planes to accommodate the introduction of an elongated object therebetween.

FIG. 2C shows slide carrier 19 having reached its opposite or lowermost extreme in its permitted range of motion in guide slot 20. Again, because of arms 30 being connected to slide carrier 19, those ends are held near the center line of this carrier and again force heating structures 21 against one another at the inner faces thereof. A position above the lower surface of the vertical opening in slide carrier 19 is aligned with the now exposed chamber 33 so that any elongated object 11 carried to this position by slide carrier 19 would be fully in chamber 33 with heating structures 21 brought together thereabout.

In corresponding FIG. 3C, doors 32 are shown separated and nearly completely hidden behind the end plates of heating structures 21 because slide carrier 19 keeps pins 34 spread apart by its width. Thus, chamber 33 is fully exposed to its ends to permit an elongated object 11 to extend therethrough with heating structure 21 thereabout. Heating proceeds of the central portion of the object between the parts thereof supported in the vertical openings of slide carriers 19.

Note that if slide carriers 19 were somewhat longer with bulging sides at their middles (shaped something like the upper or lower half of an hourglass with a vertical slot in the top thereof) they could operate heating structures 21 in the same way they operate doors 32. That is, they could engage pins extending from each heating structure 21 side to permit these structures to come together at each end of such slider's range of motion but to separate for slider positions in between. Arms 30 would not then be needed, but springs in place of torsion springs 31 would be required to tend to force heating structures 21 together.

Slide carrier 19, in this lowermost extreme of its permitted range of motion, engages spring restraint 22 of FIG. 1 (see FIG. 5) in an opening, 36, in slide carrier 19. As earlier indicated, this restraint holds slide carrier 19 at its lowermost extreme for a time duration determined by an external control system, which duration is ended by such external control system electrically energizing electrical solenoid 24 through wires 23 to disengage spring restraint 22 from slide carrier 19. At such disengagement, torsion springs 31 force arms 30 upward so that slide carrier 19 follows in reverse the contimuum of positions taken in its previous downward course of motion.

During this upward return, the position shown in FIGS. 2B and 3B occurs again so that an elongated object 11, supported in the vertical opening in slide carrier 19 and in the central opening of grippers 12, can be extracted from heating structures 21. At the end of the upward motion of slide carrier 19 due to the force provided by torsion springs 31, carrier 19 is again in the position shown in FIGS. 2A and 3A with elongated object 11, after being heated in a desired manner, being available to an operator. The operator can then lift this object from the bottom surface of the vertical opening in slide carrier 19, and from between grippers 12 against the action of torsion springs 16, in its altered form resulting from the heating for further use. Use of easily selectable temperatures, easily selectable heating times, and heating depending only on "wrap around" heating structures positioned consistently and independently with respect to the heated object or the operator, means that operators of heating system 10 can obtain consistent and reliable results with little training.

The final portions of the upward travel of slide carrier 19 are damped by the presence of damping springs, 37, mounted in conjunction with rods, 38, supporting end frames 26. Springs 37 aid in causing slide carrier 19 to decelerate in its upward motion, and therefor come to a less abrupt stop.

Figure 4:
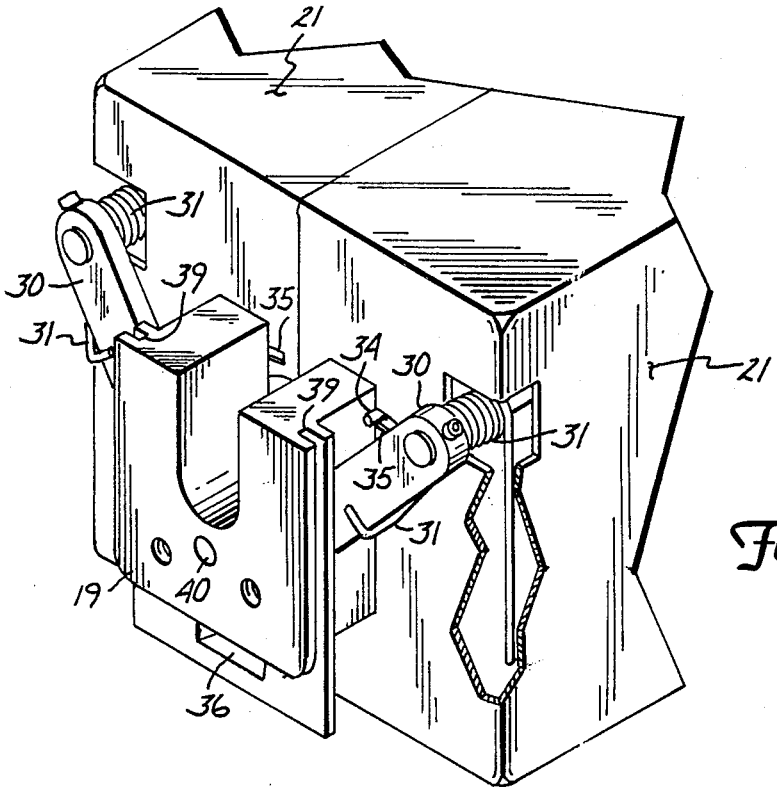
FIG. 4 shows a breakout view of a portion of the present invention.

FIG. 4 shows the details of the mechanical connections between heating structure 21 and a slide carrier 19, shown on one end of the pair of heating structures 21, as made by a pair of connecting arms 30. In particular, a "breakaway" of a portion of one of the members of the pair of heating structures 21 is provided to show how torsion spring 31 is positioned around the pivot rod extending between an arm 30 at one end of heating structure 21 and a similar arm 30 at the opposite end. The "breakaway" only shows the details of one end with a free end of the torsion spring 31 shown to exert its force against the back plate of a heating structure 21. The other free end of torsion spring 31 is provided against the underside of arm 30 so that torsion spring 31 is always attempting to rotate arm 30 clockwise with respect to the pivot rod parallel to the back plate of heating structure 21.

Figure 7:
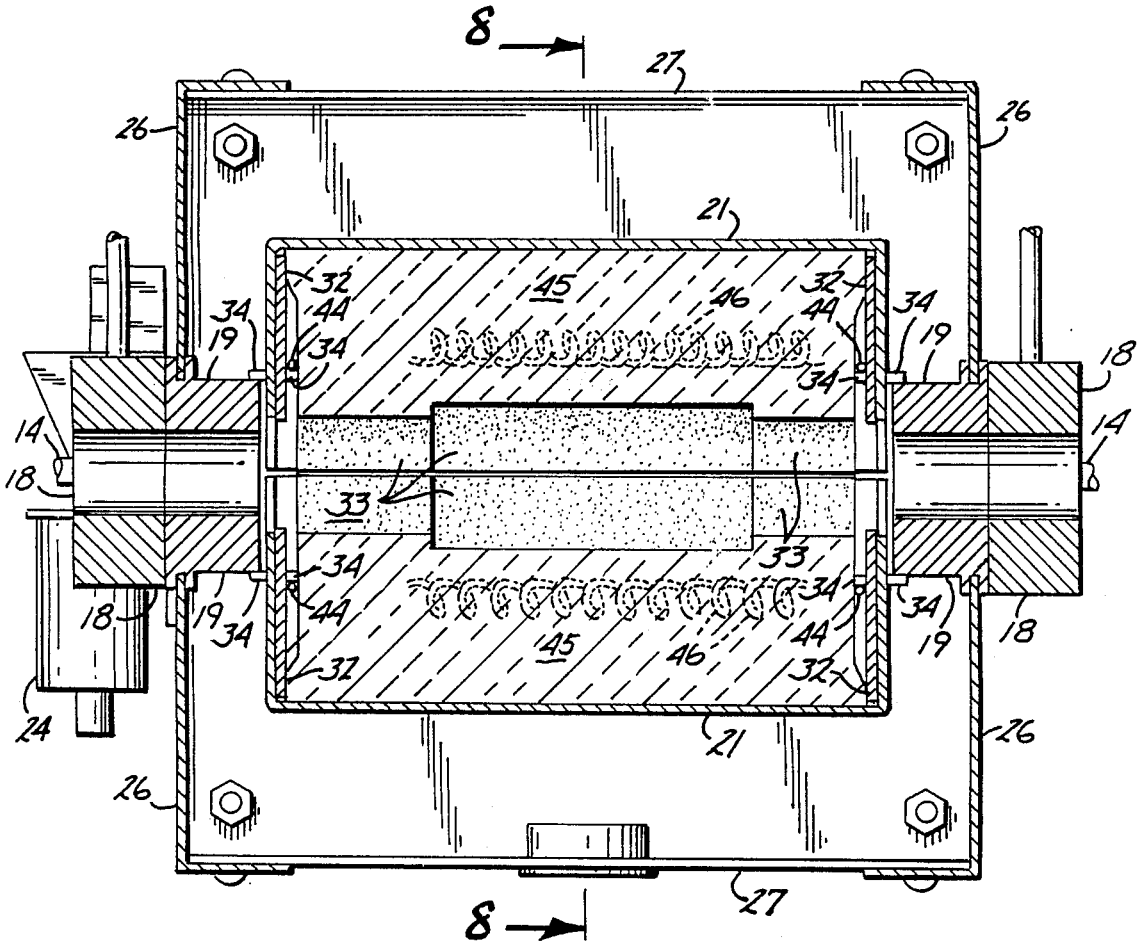

Vertical slots, 39, on either side of slide carrier 19 just behind the front face thereof, are where slide carrier 19 engages end frame member 26 on either side of guide slot 20 (see FIG. 7). A similar arrangement exists at the opposite side of the pair of heating structures 21 where the other slide carrier 19, though facing in the opposite direction, engages the other end frame 26 at the sides of the slot 20 therein. This engagement is again by the corresponding vertical slots 39 in this other slide carrier 19.

Openings 36, shown in FIG. 4, in slide carrier 19, permit engagement by spring restraint 22. An opening 36 occurs similarly in that slide carrier 19 positioned at the opposite end of heating structure 21 for spring restraint 22 provided there.

Doors 32, in being kept apart by slide carriers 19 if at the lowermost extremes in the ranges of motion thereof, are kept from being in contact with any elongated object 11 being heated in chamber 33. As a result, elongated object 11, after sufficient heating of a first portion thereof, could be pulled to a new position for heating of another portion without having slide carriers 19 released to return object 11 to the position it would take with slide carriers 19 returning to the positions shown therefor in FIGS. 2A and 3A. This can be very advantageous in allowing the heating of successive portions of an elongated object continuously through causing such object to be pulled continually, or in regular steps, through chamber 33 at a desired rate to assure the heating thereof desired. In such a situation, a timer would not be provided, and perhaps, a solenoid such as solenoid 24 would not be used at all, relying instead on a manual push of actuator 25 by the operator when the elongated object came to an end to return slide carrier 19 to the position shown in FIGS. 2A and 3A.

The two threaded holes shown in slide carrier 19 in FIG. 4 are for screws which attach push plate 18 thereto. The opening, 40, therebetween is to permit attachment to a source of pressurized air to provide an air stream flowing through this opening, which extends through slide carrier 19, and out the opposite side of slide carrier 19 into chamber 33 in certain heating situations. Such situations occur, for instance, if there is a desire to have surface cooling of an elongated object 11 in chamber 33 while interior heating thereof continues from the radiant heat being provided at the inner faces of heating structures 21. This air stream in chamber 33 can prevent damage caused by undue surface heating of elongated object 11 while assuring that internal portions of object 11 are sufficiently heated. An alternative use is to assure that shrinkable tubing being heated shrinks from its central portions toward its ends rather than shrinking at the ends first and then toward its central portion. This can assure that there will be no air entrapment in the interior of the shrinkable tubing as a result of the shrinking operation. To provide equal cooling at each end for this purpose, a similar port for an air stream is provided in that slide carrier 19 provided at the opposite end of the pair of heating structures 21.

Figure 5:
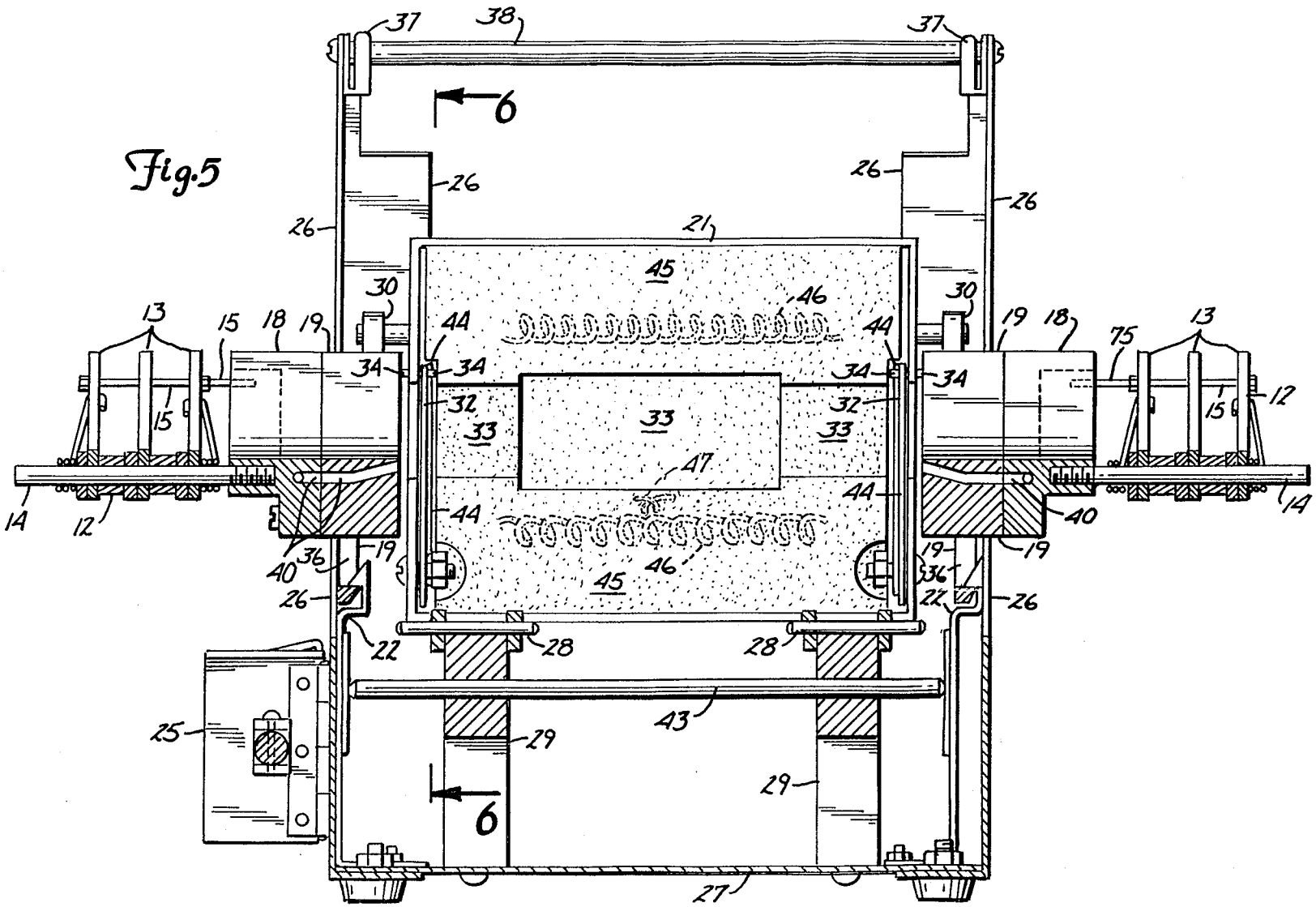

Ports 40 for air streams in slide carriers 19 are shown more clearly in the cross section view of FIG. 5. This cross section is taken of heating system 10 in FIG. 1 in a plane parallel to, and through, the inner faces of each of the heating structures 21 as they are in the closed position achieved in FIGS. 2C and 3C. Again, there is no showing of an elongated object 11 for heating because it would obscure the view in FIG. 5. Also, electrical interconnections are omitted in this figure.

The channels, or ports 40, can be seen in FIG. 5 to come out the sides of plates 18 and to extend through each of slide carriers 19 to a point across from chamber 33. The orifices for ports 40 appearing in the face of plate 18 accommodate tubes from a source of pressurized air or other gas.

Spring restraints 22 are shown in FIG. 5 engaged in openings 36 of slide carriers 19 to hold these carriers in the positions shown. Restraints 22 are formed from strips of resilient metal so that the spring force therein always urges them toward the positions taken in openings 36 in carriers 19 at the lowermost extremes of the ranges of motion of each. Release of slide carriers 19 from engagement with spring restraints 22, serving to immobilize these slide carriers at these lowermost extremes to provide the required heating time, is effected by actuator 25 being caused to rotate on the hinge which attaches it to end frame member 26. Actuator 25 rotates through a slot, 41, in that end frame member 26 to which it is attached to thereafter push against spring leaf restraint 22 forcing it out of opening 36 in slide carrier 19.

As earlier indicated, such a rotation of actuator 25 through slot 41 is given effect by solenoid 24 which has its plunger attached to actuator 25 by a yoke having a pin therethrough permitting rotation of actuator 25 about that pin. The plunger of solenoid 24, in the absence of electrically energizing of the solenoid, is forced by a spring therein to push actuator 25 against a restraining stop, 42. The electrical energizing of solenoid 24 causes the plunger therein to move to the right in FIG. 1, causing actuator 25 to rotate into slot 41 and push against spring restraint 22. A push rod, 43, as shown in FIG. 5, extends through each of supports 29 and between the two spring restraints 22. Thus, actuator 25, in pushing the spring restraint 22 nearest to it, also through push rod 43, pushes the opposite spring leaf 22 out of opening 36 in that slide carrier 19 positioned at the opposite end of heater system 10 from actuator 25. Since actuator 25 can also be operated manually against the spring in solenoid 24, an operator of heating system 10 can always cause the immediate cessation in heating of an object for safety purposes or other reasons.

In FIG. 5, the edges of each of doors 32 in heating structure 21 can be seen at the opposite ends of chamber 33. Pins 34 which go through doors 32 and through slots 35 in the end plates of heating structure 21 can be seen to extend past each of slide carriers 19 to be engaged by these carriers. The opposite ends of pins 34 engage torsion springs, 44, which act to keep doors 32 closed in the absence of slide carrier 19 forcing them open.

Figure 6:
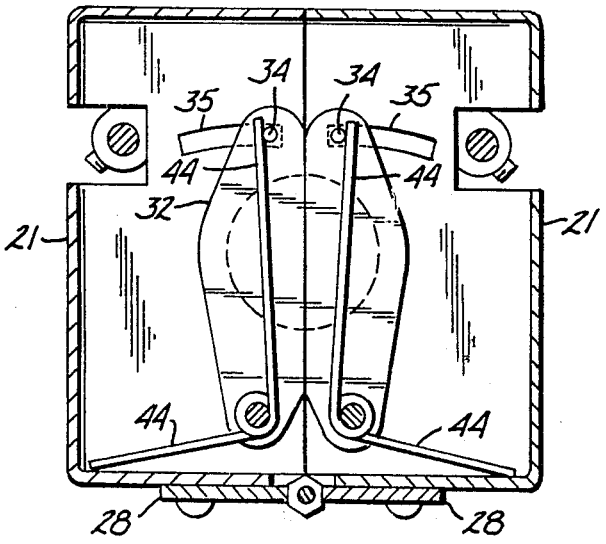
FIGS. 5, 6, 7 and 8 show various cross section views of the heating system of the present invention.

Springs 44 are better seen in FIG. 6, which is a portion of a cross section view of heating system 10 in FIG. 1 but which is more conveniently indicated as a section view 6—6 in FIG. 5. That is, both heating structures 21 are shown in FIG. 6, even though only one is present in FIG. 5. Torsion springs 44 can be seen to act against the bottom plate of each of heating structures 21 and against pins 34 in doors 32. These torsion springs are held by the pivot means which hold each of doors 32 to its respective end plate of its corresponding heating structure.

Further shown in FIG. 5 is an inner face of one member of the pair of heating structures 21. Heating structure 21 is formed of a metallic outer shell having a back plate, top and bottom plates, and end plates, as earlier indicated. These designations for constituent portions of this shell are for convenience of reference only—there may not be separate plates used to form the shell, but rather a stamped single sheet of metal may be used. Within this metallic shell is a ceramic mass, 45, cast in place about a set of Nichrome electrical resistance coils, 46. Electrical current supplied along wires 23 connected to coils 46 will heat them to temperatures sufficiently high to provide radiant energy in chamber 33. The temperature reached in chamber 33 is monitored by a thermocouple, 47, which is embedded in ceramic mass 45 and which provides electrical signals along wires 23 indicating the temperature achieved near chamber 33.

The portion of chamber 33 shown in FIG. 5 is formed by a recess in ceramic mass 45 extending from one side of ceramic mass 45 to the other, i.e. from one side of heating structure 21 near a slide carrier 19 to the opposite side near the remaining slide carrier. Again, chamber 33 is closed off to the outside by doors 32 to save heat energy if slide carrier 19 is in its uppermost extreme of its range of motion, but these doors open as slide carrier 19 moves downward, doors 32 becoming fully opened as slide 19 reaches its lower extreme in its range of motion, as earlier indicated.

The recess in each of the ceramic masses 45 in each of heating structures 21, together forming a complete chamber 33, can best be seen in FIG. 7, which is a cross section of FIG. 1 looking down and assuming a top portion of heating system 10 is removed and that slide carriers 19 are both at the lowermost extremes of their permitted ranges of motion. This cross section view is designated 7—7 in FIG. 1.

In FIG. 7, electrical interconnections and grippers 12 have not been shown nor has elongated object 11. Object 11, if shown, would extend though chamber 33 and ou the openings shown in slide carriers 19 and push plates 18, openings which are vertical openings when viewed in FIG. 1. Thus, slide carriers 19 would each support a portion of object 11 beside that portion of object 11 being heated within chamber 33.

As can be seen in FIG. 7, slide carriers 19 have engaged pins 34 and kept the pins spread apart so that doors 32 are open. Thus, there would be no interference with elongated object 11 in extending through chamber 33 and out the openings in slide carriers 19 and push plates 18.

Further in FIG. 7, the engagement of slots 39 in each of slide carriers 19 with the corresponding end members 26 can be seen. Thus, guide openings 20 in FIG. 1 have sides thereof formed by end member 26 providing vertical direction motion guidance to slide carriers 19 so that they move in vertical directions. While this means of guiding slide carriers 19 is convenient, other guiding arrangements permitting such motion by slide carriers 19 could alternatively be used. These arrangements would include the use of bearings if required in larger scale versions of heating systems 10.

Figure 8:
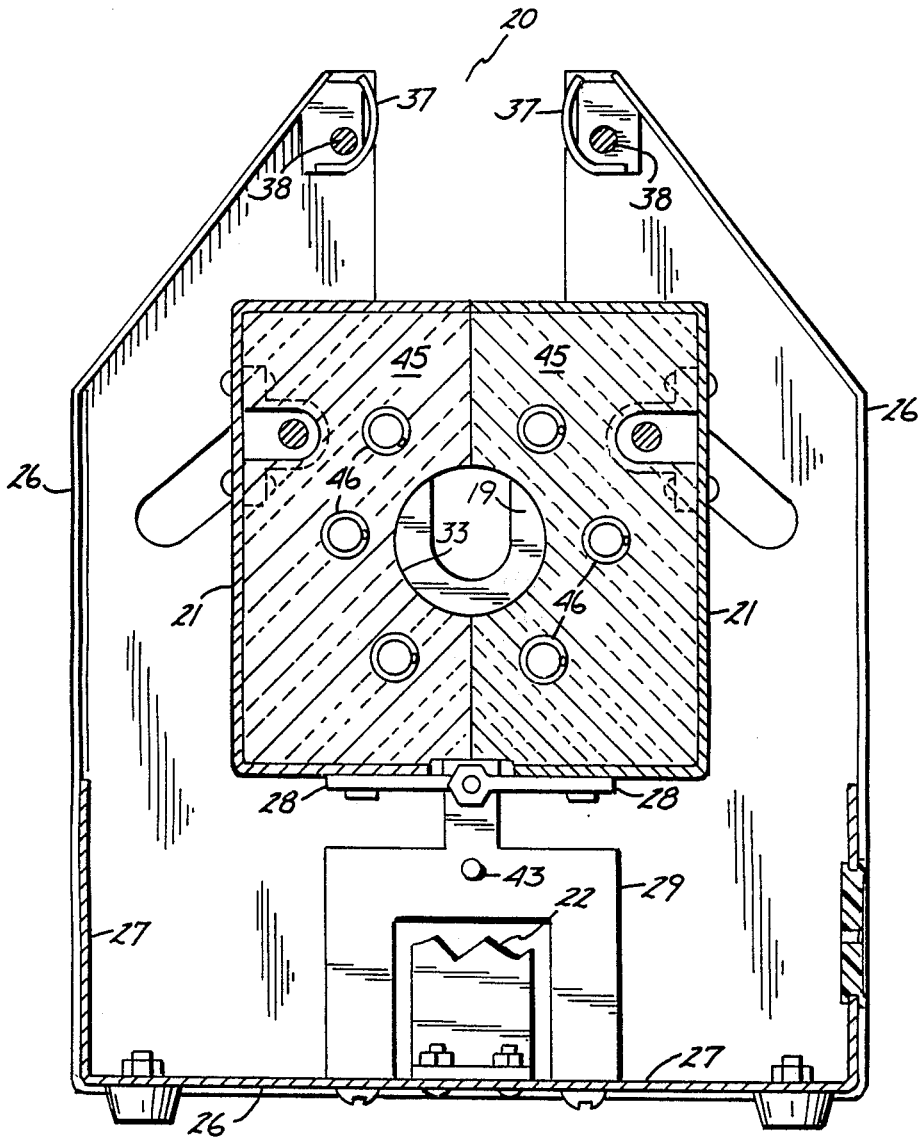

FIG. 8 shows a cross section view designated 8—8 in FIG. 7, providing an alternative view of chamber 33 with Nichrome heating coils 46 thereabout. Again in FIG. 8, no electrical interconnections are shown nor is any elongated object 11 shown. FIG. 8 shows coils 46 grouped relatively close the chamber 33 to assure that temperatures well in excess of 1,000° F. in this chamber can be achieved. Further, coils 46 are spaced relatively far from the metallic shells of heating structures 21. Ceramic mass 45 provides an insulative effect to assure that the heat generated by coils 46 is primarily provided at the inner faces of heating structures 21 where they meet, and there primarily at chamber 33.

Heating system 10 has been presented in the figures referenced above as a manually operated system, except for temperature setting controls and controls used for energizing solenoid 24 to cause disengagement of the restraints 22 after selected times, none of these controls having been shown. However, heating system 10 can easily be adapted for use in an automated usage situation by supplying motor means to replace an operator to push on push plate 18 to initiate a heating sequence. Many kinds of motor means could be considered for this purpose, including an electric motor driving crank arms, or hydraulic actuators, or the like.

Figure 9:
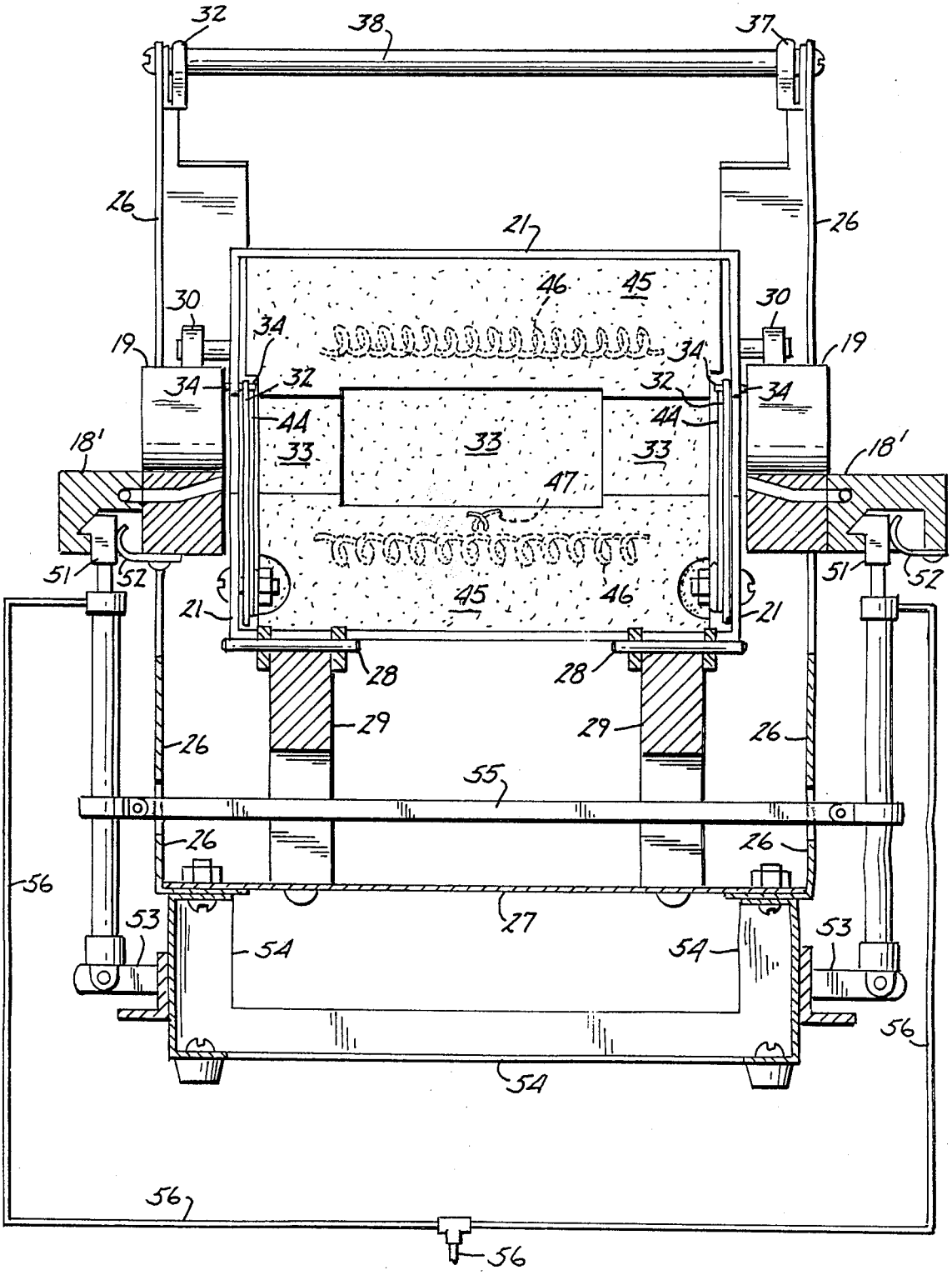
FIG. 9 shows an alternative embodiment of the system of the present invention.

FIG. 9 shows one of these alternatives, the use of a pair of pneumatic actuators, 50. As shown in FIG. 9, actuators 50 each engage a modified plate, 18', attached to a corresponding slide carrier 19. This engagement is formed by actuator heads, 51, affixed to the ends of the air driven plungers within the cylinders of each of actuators 50, each of heads 51 engaging a shelf portion in a corresponding one of plates 18'. Each of heads 51 is urged in position against such a shelf by a corresponding spring, 52. The opposite ends of actuators 50 are each connected to a support, 53, by a pivot pin which permits actuators 50 to rotate within some angle in the plane of the drawing with respect to supports 53. Supports 53 are affixed to a base member, 54.

This pivot arrangement allows actuators 50 to be pushed out of engagement with the shelf portions in plates 18' against the forces of springs 52 by pushing either the left hand one or pulling on the right hand one. Either of these actions is transmitted to the other by virtue of a connecting rod, 55, which connects actuators 50 together so that if one rotates with respect to one of its supports 53, the other does also with respect to its support 53. Thus, in response to any need to quickly remove an object 11 being heated in chamber 33 from that chamber for safety or other reasons, a push or pull on the proper one of actuators 50 will disengage them both from the shelf portions in plates 18. Springs 31 can then force slide carrier 19 towards the uppermost extreme of the ranges of motion thereof.

In operation, the plungers of actuators 50 with heads 51 would initially be fully extended out of the cylinders thereof so that slide carriers 19 are at the uppermost extremes in range of motion. Provision of air of sufficient pressure in air supply lines, 56, connected to each of actuators 50 will cause these plungers to retract within actuators 50 to pull slide carriers 19 down toward the lowermost extremes in such ranges of motion. The continuation of air pressure to actuators 50 for a selected amount of time will hold slide carriers 19 against springs 31 in this lowermost extreme until heating of an elongated object in chamber 33 is completed. Thereafter, the pressurized air supplied to actuators 50 is released and springs 31 acting on arms 30 cause slide carriers 19 to return to the initial uppermost extremes, thereby removing the object being heated in chamber 33 in the manner previously described. In this mode of operation, there is no need to have spring restraints 22, and they have not been shown in FIG. 9.

The arrangement shown in FIG. 9 is just one possibility for use of heating system 10, or variations thereof, in an automated setting. A vertical conveying system could be used in conjunction with the system of FIG. 9 to regularly provide objects for heating in heating system 10 by having a loading means of some sort place objects from the vertical conveying means in slide carriers 19 to begin the heating sequence. Grippers 12, shown in FIG. 1 but not shown in FIG. 9, though easily provided if desirable, could aid such loading of heating system 10. A horizontal traveling conveyor over the top of heating system 10 carrying object to be heated below it along with a loading means could also be used.

Alternatively, heating system 10 could be operated in a position rotated 90° from that shown in FIG. 1 or in FIG. 9 to make loading thereof from a horizontally travelling conveyor belt more convenient. Again, such loading could be effected by some sort of an insertion means operating in conjunction with the horizontal conveyor means, including one or more robots. Further, as earlier indicated, the presence of a continuous or nearly continuous supply of objects to be heated, such as in a coil, permits inserting an end of such an object in chamber 33 and having the remainder pulled through that chamber at selected rates. Thus, although the present invention has been described with reference to preferred embodiments, workers skilled in the art will recognize that changes may be made in form and detail without departing from the spirit and scope of the invention.

What is claimed is:

1. An enveloping heater which opens to receive an object to be heated as a carrier therefor reaches a position suitable for inserting said object therein, said heater comprising:

a pair of heating structures which can be brought together at an inner face of each with at least some portions of each said inner face being immediately adjacent to one another, and can be separated to space apart said inner faces with at least one of said inner faces being where heat can be primarily provided;

a first slide carrier positioned adjacent to said pair of heating structures, said first slide carrier having a first mechanical relationship to at least one member of said pair of heating structures so that said first slide carrier has a range of motion such that if said first slide carrier is positioned sufficiently toward either of its opposite ends of its range of motion that said pair of heating structures are brought together at said inner faces thereof as aforesaid, but if said first slide carrier is at least at one intermediate position in its range of motion that said pair of heating structures are spaced apart, as aforesaid; and a frame having an elongated guiding means therein in which said first slide carrier is provided, and in which said first slide carrier is afforded said range of motion.

2. The apparatus of claim 1 wherein there is provided a second slide carrier in a side of said pair of heating structures opposite from said first slide carrier, said second slide carrier having a range of motion at least that of said range of motion of said first slide carrier and in said directions taken by said first slide carrier in its said range of motion if said slide carrier is free of any immobilizing restraints provided therefor in said heater, if any, said second slide carrier having a second mechanical relationship to at least one member of said pair of heating structures.

3. The apparatus of claim 1 wherein said pair of heating structures, in being separated and brought together as aforesaid, has in doing so at least one member which moves by rotation about at least one heating structure pivot means.

4. The apparatus of claim 1 wherein said first slide carrier also has a second mechanical relationship to that one of said pair of heating structures opposite that to which said first mechanical relationship exists.

5. The apparatus of claim 1 wherein said pair of heating structures if brought together as aforesaid contain a chamber formed by a recess in at least one of said inner faces.

6. The apparatus of claim 1 wherein said first mechanical relationship is a first mechanical connection and said first slide carrier can be forced through its said range of motion in at least one of said directions thereof by a spring means acting on said first mechanical connection, said spring means being able to store mechanical energy therein.

7. The apparatus of claim 1 wherein said first slide carrier can be forced through its said range of motion in at least one of said directions thereof by a motor means acting on said first slide carrier, said motor means being energized from an external source of energy.

8. The apparatus of claim 1 wherein said heat which can be primarily provided at a said inner face can be provided at both said inner faces and from radiant energy sources.

9. The apparatus of claim 2 wherein said first mechanical relationship is a first mechanical connection and said second mechanical relationship is a second mechanical connection, said second mechanical connection being made to that member of said first pair of heating structures to which said first mechanical connection is made.

10. The apparatus of claim 3 wherein said pair of heating structures, in being separated and brought together as aforesaid, has in doing so each member thereof move by rotation about at least one heating structure pivot means.

11. The apparatus of claim 4 wherein said first mechanical relationship is a first mechanical connection in the form of a first arm joined to said first slide carrier by a first arm first pivot means and joined to a member of said pair of heating structures as aforesaid by a first arm second pivot means.

12. The apparatus of claim 5 wherein there is a recess in each of said inner faces which together form said chamber with each of said recesses extending entirely across its corresponding said inner face between opposite sides of that member of said pair of heating structures in which it is provided.

13. The apparatus of claim 6 wherein said spring means has a substantial mechanical energy stored therein if said first slide carrier is positioned at substantially one extreme of its said range of motion, said first slide carrier being selectively held at such substantial extreme by a first restraint means.

14. The apparatus of claim 8 wherein at least one of said pair of heating structures has an electrical resistance heater provided therein positioned in a ceramic holder means to provide radiant heat.

15. The apparatus of claim 8 wherein a first stream of air is directed from a source of flowing between said inner faces if said first slide carrier is at one extreme of its said range of travel.

16. The apparatus of claim 9 wherein said first mechanical connection is a first arm joined to said first slide carrier by a first arm first pivot means and joined to a member of said pair of heating structures as aforesaid by a first arm second pivot means, and said second mechanical connection is a second arm joined to said second slide carrier by a second arm first pivot means and joined to a member of said pair of heating structures as aforesaid by a second arm second pivot means.

17. The apparatus of claim 10 wherein each member of said pair of heating structures of rotating about a said corresponding heating structure pivot means, rotates about a common heating structure pivot means.

18. The apparatus of claim 11 wherein said second mechanical relationship is a second mechanical connection in the form of a second arm joined to said first slide carrier by a second arm first pivot means and joined to a member of said pair of heating structures as aforesaid by a second arm second pivot means.

19. The apparatus of claim 12 wherein said chamber has its axis substantially in line with a location adjacent to a support surface in said first slide carrier at substantially one extreme in its range of motion with said opening being such that an object to be heated can be placed therein so that said object, if extended sufficiently along said axis toward said chamber from said support surface, would have at least a portion thereof within said chamber.

20. The apparatus of claim 13 wherein said first restraint means is a spring means which acts to engage and hold said first slide carrier at said substantial extreme of its said range of motion but which can be removed from engagement with said first slide carrier by a force applied thereto.

21. The apparatus of claim 14 wherein a temperature measuring means is also provided in said ceramic holder means which is electrically connected to a control means permitting control of electrical current through said electrical resistance heater to permit selecting a temperature to occur near said interface of said member of said pair of heating structures in which said temperature measuring means is provided as aforesaid.

22. The apparatus of claim 14 wherein each of said members of said pair of heating structures contains a ceramic holder means having an electrical resistance heater therein to provide radiant heat.

23. The apparatus of claim 16 wherein said first slide carrier has a third mechanical connection to that one of said members of said pair of heating structures opposite that to which said first mechanical connection is made, said third mechanical connection being a third arm joined to said first slide carrier by a third arm first pivot means and joined to said opposite member of said pair of heating structures as aforesaid by a third arm second pivot means, and wherein said second slide carrier has a fourth mechanical connection to that one of said members of said pair of heating structures opposite that to which said second connection is made, said fourth mechanical connection being a fourth arm joined to said second slide carrier by a fourth arm first pivot means and joined to said opposite member of said pair of heating structures as aforesaid by a fourth arm second pivot means.

24. The apparatus of claim 17 wherein said common heating structure pivot means is provided by a hinge formed of two hinge plates rotatable with respect to one another, each of said hinge plates being affixed to an alternative member of said pair of heating structures.

25. The apparatus of claim 18 wherein said pair of heating structures, in being separated and brought together as aforesaid, has in doing so at least one member which moves by rotation about at least one heating structure pivot means.

26. The apparatus of claim 18 wherein said pair of heating structures if brought together as aforesaid contain a chamber formed by a recess in at least one of said inner faces.

27. The apparatus of claim 18 wherein said first slide carrier can be forced through its said range of motion in at least one of said directions thereof by a first spring means acting on said first arm and by a second spring means acting on said second arm, said first and second spring means each being able to store mechanical energy therein.

28. The apparatus of claim 18 wherein said first slide carrier can be forced through its said range of motion in at least one of said directions thereof by a motor means acting on said first slide carrier, said motor means being energized from an external source of energy.

29. The apparatus of claim 18 wherein said heat which can be primarily provided at a said inner face can be provided at both said inner faces and from radiant energy sources.

30. The apparatus of claim 19 wherein each recess in a corresponding inner face of a member of said pair of heating structures has its intersection with a said side of its corresponding said member opened or blocked selectively by a door means controlled by said first slide carrier.

31. The apparatus of claim 20 wherein an electrical solenoid means is provided to apply said force in response to electrical energizing of said electrical solenoid.

32. The apparatus of claim 20 wherein a lever means is provided to apply said force manually.

33. The apparatus of claim 22 wherein a temperature measuring means is also provided in said ceramic holder means which is electrically connected to a control means permitting control of electrical current through said electrical resistance heaters to permit selecting a temperature to occur near said interface of said member of said pair of heating structures in which said temperature measuring means is provided as aforesaid.

34. The apparatus of claim 23 wherein said pair of heating structures, in being separated and brought together as aforesaid, has in doing so at least one member which moves by rotation about at least one heating structure pivot means.

35. The apparatus of claim 23 wherein said pair of heating structures if brought together as aforesaid contain a chamber formed by a recess in at least one of said inner faces.

36. The apparatus of claim 23 wherein said first slide carrier can be forced through its said range of motion in at least one direction by a first spring means acting on said first arm and by a second spring means acting on said third arm, and wherein said second slide carrier can be forced through its said range of motion in that direction said first slide carrier can be forced, as aforesaid, by a third spring means acting on said second arm and by a fourth spring means acting on said fourth arm, said first, second, third and fourth spring means each being able to store mechanical energy therein.

37. The apparatus of claim 23 wherein said first slide carrier can be forced through its said range of motion in at least one of said directions thereof by a motor means acting on said first slide carrier, said motor means being energized from an external source of energy.

38. The apparatus of claim 23 wherein said heat which can be primarily provided at a said inner face can be provided at both said inner faces and from radiant energy sources.

39. The apparatus of claim 26 wherein there is a recess in each of said inner faces which together form said chamber with each of said recesses extending entirely across its corresponding said inner face between opposite sides of that member of said pair of heating structures in which it is provided.

40. The apparatus of claim 27 wherein said first and second spring means each has a substantial mechanical energy stored therein if said first slide carrier is positioned at substantially one extreme of its said range of motion, said first slide carrier being selectively held at such substantial extreme by a first restraint means.

41. The apparatus of claim 29 wherein at least one of said pair of heating structures has an electrical resistance heater provided therein positioned in a ceramic holder means to provide radiant heat.

42. The apparatus of claim 29 wherein a first stream of air is directed from a source to flowing between said inner faces if said first slide carrier is positioned at one extreme of its said range of travel.

43. The apparatus of claim 35 wherein there is a recess in each of said inner faces which together form said chamber with each of said recesses extending entirely across its corresponding said inner face between opposite sides of that member of said pair of heating structures in which it is provided.

44. The apparatus of claim 36 wherein said first, second, third and fourth spring means each has a substantial mechanical energy stored therein if said first and second slide carriers are each positioned substantially at a common extreme of each of said range of motion thereof, said first slide carrier being selectively held at such substantial extreme for it by a first restraint means and said second slide carrier being selectively held at such substantial extreme for it by a second restraint means.

45. The apparatus of claim 38 wherein at least one of said pair of heating structures has an electrical resistance heater provided therein positioned in a ceramic holder means to provide radiant heat.

46. The apparatus of claim 38 wherein a first stream of air is directed from a source to flowing between said inner faces if said first slide carrier is at one extreme of its said range of travel.

47. The apparatus of claim 39 wherein said chamber has its axis substantially in line with a location adjacent to a support surface in said first slide carrier at substantially one extreme of its range of motion with said opening being such that an object to be heated can be placed therein so that said object, if extended sufficiently along said axis toward said chamber from said support surface, would have at least a portion thereof within said chamber.

48. The apparatus of claim 40 wherein said first restraint means is a spring means which acts to engage and hold said first slide carrier at said substantial extreme of its said range of motion but which can be removed from engagement with said first slide carrier by a force applied thereto.

49. The apparatus of claim 41 wherein a temperature measuring means is also provided in said ceramic holder means which is electrically connected to a control means permitting control of electrical current through said electrical resistance heater to permit selecting a temperature to occur near said interface of said member of said pair of heating structures in which said temperature measuring means is provided as aforesaid.

50. The apparatus of claim 43 wherein said chamber has its axis substantially in line with a location adjacent to a support surface in said first slide carrier and a support surface on said second slide carrier substantially at a common extreme of each said range of motion thereof such that an object to be heated can be placed in both of these openings so that said object would have at least a portion thereof extending between these support surfaces within said chamber.

51. The apparatus of claim 44 wherein said first restraint means is a spring means which acts to engage and hold said first slide carrier at said substantial extreme in its said range of motion but which can be removed from engagement with said first slide carrier by a first force applied thereto, and wherein said second restraint means is a spring means which acts to engage and hold said second slide carrier at said substantial extreme of its said range of motion but which can be removed from engagement with said second slide carrier by a second force applied thereto.

52. The apparatus of claim 45 wherein a temperature measuring means is also provided in said ceramic holder means which is electrically connected to a control means permitting control of electrical current through said electrical resistance heater to permit selecting a temperature to occur near said interface of said member of said pair of heating structures in which said temperature measuring means is provided as aforesaid.

53. The apparatus of claim 46 wherein a second stream of air is directed from a source to flowing between said inner faces in a direction substantially opposite that direction said first stream of air is flowing.

54. The apparatus of claim 46 wherein a port from which said first stream of air flows is located in said first slide carrier facing said chamber and said source is connected to said first slide carrier.

55. The apparatus of claim 47 wherein each recess in a corresponding inner face of a member of said pair of heating structures has its intersection with a said side of its corresponding said member opened or blocked selectively by a door means controlled by said first slide carrier.

56. The apparatus of claim 48 wherein an electrical solenoid means is provided to apply said force in response to electrical energizing of said electrical solenoid.

57. The apparatus of claim 50 wherein each recess in a corresponding inner face of a member of said pair of heating structures has each of its intersections with one of said opposite sides of said corresponding said member opened or blocked selectively by opposite pairs of door means, a first pair of said door means being controlled by said first slide carrier and a second pair of said door means being controlled by said second slide carrier.

58. The apparatus of claim 50 wherein there is provided beside each of said support surfaces a gripping means for gripping an object to be heated which extends between said support surfaces.

59. The apparatus of claim 51 wherein an electrical solenoid means is provided to apply said first and second forces in reponse to electrical energizing of said electrical solenoid.

60. The apparatus of claim 53 wherein a first port from which said first stream of air flows is located in said first slide carrier facing said chamber and wherein a second port from which said second stream of air flows is located in said second slide carrier facing said chamber with a source for said first air stream being connected to said first slide carrier and a source for said second air stream being connected to said second slide carrier.

61. The apparatus of claim 56 wherein a lever means is also provided to permit either said electrical solenoid or said lever means to alternatively apply said force.

62. The apparatus of claim 56 wherein said electrical energizing of said electrical solenoid is controlled by a timer.

63. The apparatus of claim 59 wherein said electrical energizing of said electrical solenoid is controlled by a timer.

64. A method of heating an object presented on a carrier to an enveloping heater as said carrier reaches a position suitable for inserting said object therein, said method comprising:

providing said object on a first slide carrier adjacent to a pair of heating structures to at least one of which said slide carrier is mechanically connected, said pair of heating structures being such that they can be brought together at an inner face of each with at least some portions of each said inner face being immediately adjacent to one another, and which can be separated to space apart said inner faces with at least one said inner face being where heat can be primarily provided, and where said first slide carrier is in a frame in which said first slide carrier is afforded a range of motion such that said pair of heating structures are brought together or separated as aforesaid depending on where said first slide carrier is in its range of motion; and moving said first slide carrier with said object thereon from a position sufficiently near a first extreme in its said range of motion where said pair of heating structures have been brought together at said inner faces thereof, through intermediate positions of said first slide carrier in its range of motion where said pair of heating structures are spaced apart to permit insertion of said object therebetween, and to a position sufficiently near an opposite extreme in said range of motion of said first slide carrier where said pair of heating structures are again brought together to envelop between them at least a portion of said object.

65. The method of claim 64 wherein a first stream of air is directed to flow between said inner faces along said enveloped portion of said object after said pair of heating structures are brought together to envelop at least a portion of said object as aforesaid.

66. The method of claim 64 wherein said object, after a portion thereof has been enveloped by said pair of heating structures as aforesaid, is moved so that a different portion of said object is between said pair of heating structures.

67. The method of claim 64 wherein, after at least a portion of said object has been enveloped as aforesaid for a selected duration of time, said first slide carrier is moved back through said intermediate positions in its said range of motion to said first extreme in its said range of motion.

68. The apparatus of claim 65 wherein a second stream of air is directed to flow between said inner faces along said enveloped portion of said object in a direction substantially opposite that direction of flow of said first stream of air after said pair of heating structures are brought together to envelop at least a portion of said object as aforesaid.

69. The method of claim 67 wherein heating means for providing heat primarily at said inner faces as aforesaid are selectively set to provide a desired temperature near such an inner face prior to said moving said first slide carrier from a said first extreme in its said range of motion.

* * * * *